US007736041B2

(12) United States Patent
Tronquet

(10) Patent No.: US 7,736,041 B2
(45) Date of Patent: Jun. 15, 2010

(54) LIGHTING AND/OR SIGNALLING DEVICE FOR A MOTOR VEHICLE COMPRISING AN OUTER WALL PROVIDED WITH A HEAT EXCHANGE ZONE

(75) Inventor: Guillaume Tronquet, Montreuil (FR)

(73) Assignee: Valeo Vision, Bobigny (FR)

( * ) Notice: Subject to any disclaimer, the term of this patent is extended or adjusted under 35 U.S.C. 154(b) by 139 days.

(21) Appl. No.: 12/047,620

(22) Filed: Mar. 13, 2008

(65) Prior Publication Data

US 2008/0225537 A1 Sep. 18, 2008

(30) Foreign Application Priority Data

Mar. 15, 2007 (FR) ..... 07 01879

(51) Int. Cl.
*F21V 29/02* (2006.01)

(52) U.S. Cl. ..... 362/547; 362/373; 362/545

(58) Field of Classification Search ..... 362/373, 362/545, 547, 294, 345
See application file for complete search history.

(56) References Cited

U.S. PATENT DOCUMENTS

| | | | | |
|---|---|---|---|---|
| 6,428,189 | B1 | 8/2002 | Hochstein | |
| 7,114,837 | B2 | 10/2006 | Yagi et al. | |
| 7,249,868 | B2 | 7/2007 | Chinniah et al. | |
| 7,275,848 | B2 | 10/2007 | Chinniah et al. | |
| 7,329,033 | B2 | 2/2008 | Glovatsky et al. | |
| 7,427,152 | B2 * | 9/2008 | Erion et al. | 362/547 |
| 2004/0202007 | A1 | 10/2004 | Yagi et al. | |
| 2006/0076572 | A1 | 4/2006 | Huber et al. | |
| 2006/0181894 | A1 | 8/2006 | Chinniah et al. | |
| 2007/0008727 | A1 | 1/2007 | Chinniah et al. | |
| 2007/0091632 | A1 | 4/2007 | Glovatsky et al. | |
| 2007/0121336 | A1 | 5/2007 | Chinniah et al. | |
| 2007/0127257 | A1 | 6/2007 | Erion et al. | |

FOREIGN PATENT DOCUMENTS

| | | | |
|---|---|---|---|
| DE | 10227720 | A1 | 1/2004 |
| DE | 10258623 | A1 | 7/2007 |
| EP | 1139019 | A1 | 10/2001 |
| FR | 89371 | E | 9/1967 |
| FR | 2698055 | A1 | 5/1994 |
| FR | 2853717 | A1 | 10/2004 |
| WO | 2006052022 | A1 | 5/2006 |

* cited by examiner

*Primary Examiner*—Ali Alavi
(74) *Attorney, Agent, or Firm*—Jacox, Meckstroth & Jenkins

(57) ABSTRACT

A lighting and/or signalling device for a motor vehicle comprising an outer wall delimiting the interior and exterior of a closed chamber, a casing, a closing glass closing the casing, the glass and casing forming at least partly the outer wall of the chamber, at least one light source inside the chamber, at least one heat exchange zone for transferring heat from inside to outside the chamber outer wall including the heat exchange zone, the heat exchange zone being able to be in contact with a fluid capable of circulating in the region of this heat exchange zone, so that the fluid enables heat emitted in the region of the heat exchange zone to be evacuated.

18 Claims, 3 Drawing Sheets

FIG.3A
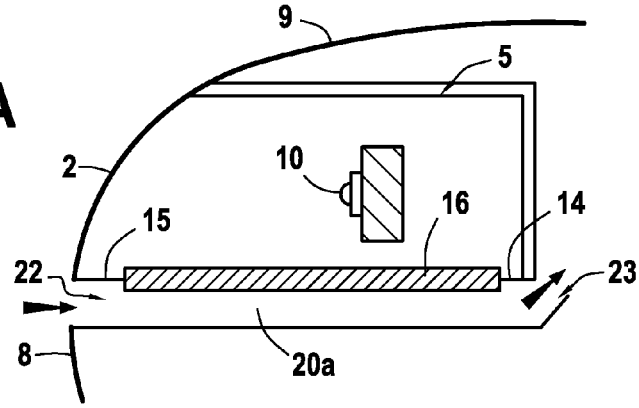
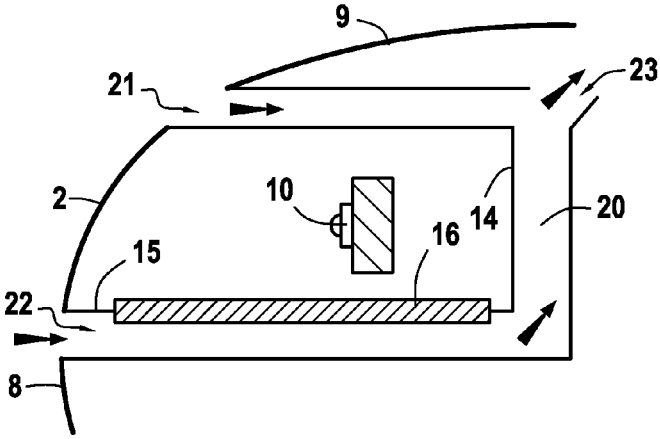
FIG.3B
FIG.3C
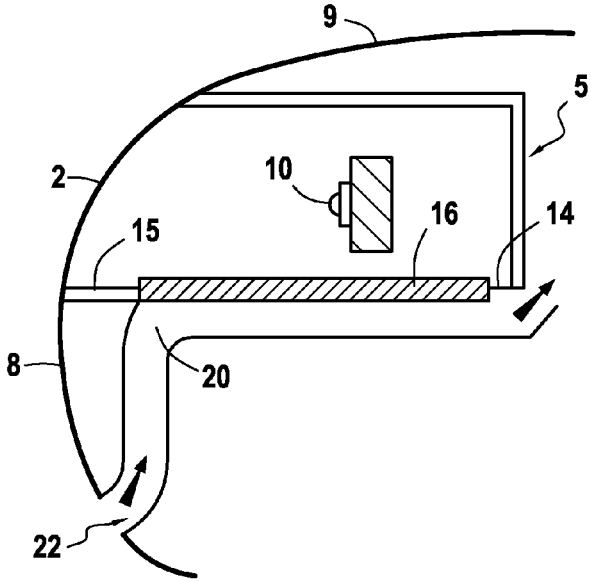

LIGHTING AND/OR SIGNALLING DEVICE FOR A MOTOR VEHICLE COMPRISING AN OUTER WALL PROVIDED WITH A HEAT EXCHANGE ZONE

BACKGROUND OF THE INVENTION

1. Field of the Invention

The invention relates to a lighting and/or signalling device comprising means for removing heat produced by the light source or sources of the device. More particularly, the invention relates to a lighting and/or signalling device for a motor vehicle comprising a chamber inside which at least one light source is positioned, the chamber having an outer wall provided with a heat exchange zone for transferring heat from the inside to the outside of the chamber. The invention also relates to a vehicle fitted with such a device, as well as a method for producing a casing adapted to the present invention.

2. Description of the Related Art

The "heat exchange zone" of the outer wall is understood to mean a zone that will exchange heat from the inside to the outside of the chamber, in a preferred manner compared with the other zones on the outer wall that will not have been defined as heat exchange zones. For example, a zone of the outer wall consisting of a thermally conducting material or a heat exchanger included in the wall constitutes a heat exchange zone.

The present invention is particularly valuable in the case of a lighting and/or signalling device comprising electroluminescent diodes or LEDs, more particularly in the case of headlights using power LEDs.

In the prior art, the use of an electroluminescent diode has been already proposed by reason of the many advantages that it presents.

Indeed, an LED consumes less electrical energy, even at equal luminous flux intensity, than a discharge or incandescent lamp that is traditionally used in the automotive field.

An LED does not radiate in an omnidirectional manner, but radiates in a more directional manner than a discharge lamp. Thus the quantity of light lost, and therefore of electrical energy lost, is lower.

LEDs also take up little room and may be positioned in much more confined spaces, and their particular shape offers new possibilities for producing and arranging complex surfaces that are associated with them.

Initially, LEDs were used in signalling lights or the rear lights of vehicles that required much less luminous power than lighting devices.

At the present time, an increase in the available power for LEDs makes it possible to envisage novel uses for these light sources, in particular for achieving lighting functions in lights at the front of the vehicle. In this case, the LEDs used are power LEDs. The expression "power LED" denotes an electroluminescent diode of which the luminous flux is of the order of at least 30 lumens.

However, a power LED produces heat as it operates. Heating of the LED is prejudicial to its satisfactory functioning, since the more the temperature of the diode rises, the more its luminous flux diminishes. Moreover, in the confined space of a headlight, the possibilities of removing heat are very limited and the temperature inside the headlight can rise very rapidly. Now, LEDs do not withstand temperatures as high as those that discharge lamps or halogen lamps withstand. More particularly, LEDs possess a maximum junction temperature of between 125 degrees Celsius (°C.) and 150° C., above which LEDs exhibit not only a reduction in efficiency but also a risk of breaking.

The heat produced by the diodes is not produced by its beam, which does not contain infrared radiation (cold light is referred to). This heat is, on the other hand, produced in the LED itself. In order to reduce its operating temperature, the LED has a metal heat-dissipating base, often called a "slug" that makes it possible to establish thermal contact with a heat dissipater, such a radiator, in order to dissipate the heat produced by the LED. Such a dissipater is in particular described in application EP-A-1 139 019. However, the heat dissipater removes heat in the region of the LED but inside the headlight, of which the internal temperature will increase.

It is difficult to evacuate heat to outside the headlight, in particular by reason of the fact that this is in contact with the engine compartment which constitutes a heat source, often between 70° C. and 80° C. when the vehicle is operating. For example, when the temperature outside the vehicle is 40° C., the temperature in the region of the engine compartment being approximately 70° C., a temperature of 90° C. is easily reached inside the headlight. Consequently, it becomes much more difficult with a single heat dissipater to remove heat in the region of the LED so that it does not reach its maximum junction temperature.

Various solutions have appeared in the prior art for removing heat from the inside to the outside of the headlight.

Document US2006/0076572 describes, and illustrates in its FIG. 4, a headlight inside which a diode is positioned mounted on a heat dissipater. A heat exchanger is positioned at the bottom of the casing of the headlight, on the wall of this casing. Through the difference in thermal gradient, heat dissipated by the heat dissipater is transferred through the space of the casing to the heat exchanger, which transmits this heat outside the casing. As illustrated in FIG. 5 of US2006/0076572, it is possible to position a fan for circulating air between the heat dissipater and the heat exchanger. Another solution illustrated in FIG. 6 of US2006/0076572, consists of directly connecting the casing to the heat dissipater on which the LED is mounted. According to another embodiment, illustrated in FIG. 7 of US2006/0076572, the heat dissipater is directly connected to a heat conductor, that in this way conducts heat to one of the parts of the heat conductor forming one with part of the wall of the casing. However, these embodiments do not enable the temperature to be reduced effectively below a certain temperature. Indeed, the heat exchange between the outside and the inside of the headlight occurs in the region of the casing and in particular of the engine compartment.

Patent application US2006/0181894 discloses a headlight of which the casing is traversed right through with a cooling duct inside which air circulates coming from outside the vehicle. Vanes positioned on the duct, inside the chamber defined by the casing closed by the outer glass, enables heat inside the chamber to be evacuated through the duct. However, the structure of such a headlight is complex to produce in the region of the wall of the casing, supplementary holes having to be sealed.

Patent application DE10258623 discloses a headlight in which the casing of the headlight is thermally insulated. In order to be insulated, the wall of the casing consists of two walls separated by an insulating space and sealed between each other at their ends, in this way forming a closed cavity. A thermally conducting part is positioned at the bottom of the casing and inside the chamber consisting of the casing and the glass. It extends from the light source in the vicinity of the glass, in this way enabling the air to be heated in the vicinity of the base of the glass of the glass of the vehicle. Since this air is hotter, it will rise inside the chamber, along the wall of the glass and thus be cooled. This type of headlight permits positioning in the region of the engine compartment while insulating the casing from the engine. However, the area of the glass must be sufficiently large compared with the volume of the chamber, so as to be able to evacuate heat sufficiently. Now, it is necessary to preserve a large degree of freedom of design of the headlight so as to be able to adapt to the internal structure of the vehicle and its body. This embodiment is therefore not entirely satisfactory. Its design is complex and restricting and increases the number of parts to be produced.

SUMMARY OF THE INVENTION

The object of the present invention is therefore to produce a device that is simpler in its production and in its structure and that depends little on constraints associated with the structure of the vehicle.

Thus, the object of the present invention is a lighting and/or signalling device for a motor vehicle comprising:

- an outer wall delimiting the interior and exterior of a closed chamber,
- a casing,
- a closing glass closing the casing, so that the casing and the closing glass form at least partly the outer wall of the chamber,
- at least one light source inside the chamber,
- at least one heat exchange zone for transferring heat from inside the chamber to outside the chamber, the outer wall including the heat exchange zone,
- said heat exchange zone being able to be in contact with a fluid capable of circulating in the region of this heat exchange zone, so that the fluid enables heat emitted in the region of the heat exchange zone to be evacuated.

According to other characteristics of the lighting and/or signalling device according to the present invention:

- the light source comprises at least on LED;
- the casing has an insulating wall continuous with the heat exchange zone, this permitting the evacuation of heat to be concentrated in the region of the heat evacuation zone;
- the insulating wall includes at least one closed cavity. This cavity reinforces the insulation and may be filled with a gas, for example air, foam, an insulating liquid, or any other insulating material;
- the insulating wall comprises two walls separated from each other by a space. This makes it possible to create a cavity separating the two walls, a cavity that can also be filled with a gas, a liquid or an insulating material such as referred to above;
- the casing includes at least one heat exchange zone, in this way making it possible to position the heat exchange zone inside the body of the vehicle;
- the device according to the present invention additionally includes a duct for circulating a fluid in contact with at least part of the heat exchange zone of the casing, in this way making it possible to increase the rate of heat evacuation;
- the duct includes a first opening, the opening being positioned in the region of the end of the casing in contact with the glass, this simple embodiment making it possible to circulate air from outside the vehicle to the inside of the duct, when the vehicle is moving;
- the duct is designed to be connected to a cooling system of part of the vehicle, so that the cooling fluid of the cooling system circulates inside the duct. Although more complicated than the previous one, this system makes it possible to evacuate heat effectively when the vehicle is at rest or when the profile of the headlight would not enable an air intake to be formed into which air could enter when the vehicle is moving;
- the cooling system connected to the duct is the cooling system of the motor vehicle. This embodiment is of value in particular within the context of headlamps, where the engine cooling system is close to the headlamps;
- the cooling system connected to the duct is the system for cooling the passenger compartment of the vehicle. Although further away from the headlights than the engine cooling system, the system for cooling the vehicle uses fluid at a lower temperature;
- the cooling system connected to the duct is a cooling system other than the system for cooling the engine of the vehicle and the system for cooling the passenger compartment of the vehicle;
- the heat exchange zone includes a thermally conducting material, reinforcing heat exchange in the region of this zone;
- the heat exchange zone of the casing is a radiator made of extruded metal, preferably extruded aluminum. Producing a radiator made of extruded metal is much simpler and less costly than other embodiments;
- the wall of the casing consists exclusively of heat exchange zones and of insulating walls that are continuous between themselves, in this way improving the evacuation of heat in the region of these zones;
- the light source is mounted on a heat dissipater that is connected to the heat exchange zone by a heat conducting device, such as a thermally conducting material, a heat pipe, or a Peltier element, enabling heat to be evacuated directly from its source.

All other supplementary features of the lighting and/or signalling device according to the invention, in as much as they are not mutually exclusive, are combined according all possibilities of association in order to result in various embodiments of the invention.

The invention also relates to a vehicle having:

- a lighting and/or signalling device according to the present invention, and
- a duct for circulating a fluid in contact with at least one heat exchange zone of the casing of the device, so that the fluid makes it possible to evacuate heat emitted in the region of the heat exchange zone of the casing.

In such a vehicle, the duct may not form part of the lighting and/or signalling device but forms part of the vehicle. It may also be made by mounting the casing of the device at a certain distance from an inner wall of the vehicle, for example by connecting the casing to this wall by means of struts, or by attaching the casing to the vehicle at locations where the duct does not pass.

According to other characteristics of the vehicle, the duct is connected to an air intake outside the vehicle, enabling air outside the vehicle to circulate inside said duct, when the vehicle is moving.

Preferably, the air intake is an already existing air inlet of the vehicle, in this way making it possible not to affect the style of the vehicle.

According to an alternative preferred embodiment, the air intake is situated sufficiently low at the front of the vehicle, in particular in the region of the vehicle bumper. This is particularly useful when the style of the vehicle would not enable air to enter through an orifice situated under the glass of the headlight. This is particularly the case with headlights that are much curved and placed very high on the wing of the vehicle. Indeed, the profile of these latter headlights behaves like that of an aircraft wing and it is impossible to having an excess pressure in the region of the edges of the glass of the vehicle. An air intake at this location would not be very effective.

In embodiments including an air duct, the inlet of the duct preferably has a cross section that is approximately equal to that of the air outlet of this duct.

BRIEF DESCRIPTION OF THE ACCOMPANYING DRAWINGS

Other features and advantages of the invention will become apparent on reading the following detailed description that will be understood by referring to the accompanying drawings in which:

FIGS. 3A to 3C are schematic representations of a section of a lighting device according to the present invention along the longitudinal axis of the vehicle, according to variants of the first embodiment shown in FIG. 1;

DETAILED DESCRIPTION OF THE PREFERRED EMBODIMENTS

The various elements appearing in several figures will have the same references, unless stated to the contrary. In addition, elements appearing in several figures will not be systematically described or referred to once again on each figure, particularly when different views of the same object or simple variants of the same embodiment are concerned.

A thermally conducting material denotes, in the present application, a material having satisfactory dissipating power, sufficient for evacuating all the calories produced by the light source or sources.

In the description and claims, expressions will be used in a non-limiting manner relating to positioning, such as upper, lower, under, above, to the left of, etc., with reference to objects that are shown in the corresponding figure.

Figure 1:
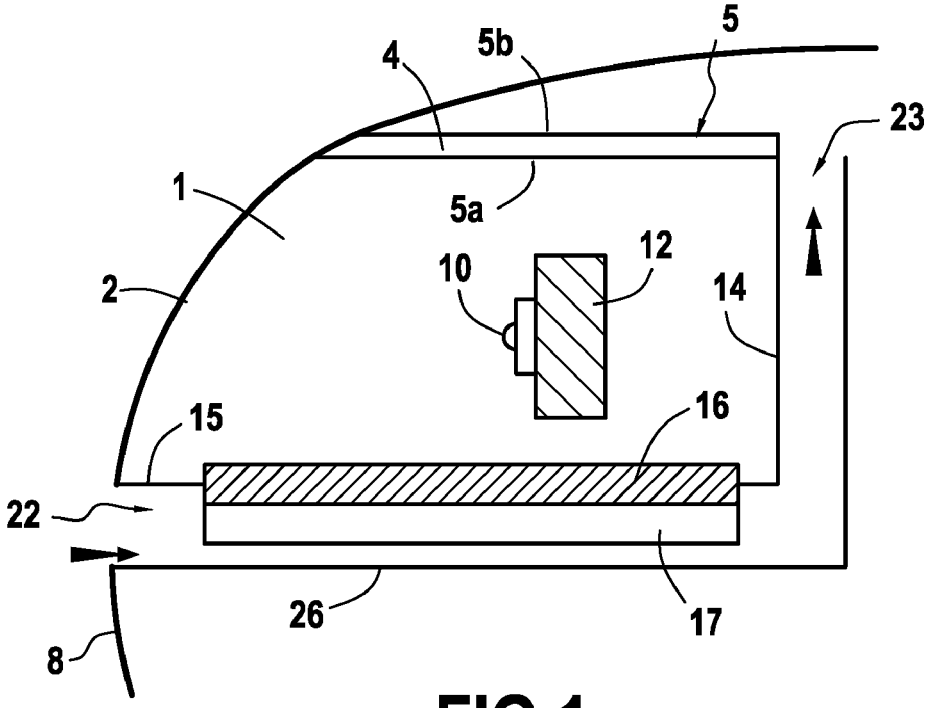
FIG. 1 is schematic representation of a section of a lighting device according to the present invention along the longitudinal axis of a vehicle, according to a first embodiment.

FIG. 1 shows a headlamp of the vehicle, of which a body, 8 and 9 is very partially shown. The headlight comprises a casing 5, closed by a glass 2, wall of the casing 5 and glass 2 constituting the outer wall of the closed chamber 1. A power electroluminescent diode, or power LED 10, is positioned inside this chamber 1. The LED 10 is in contact with a heat dissipater 12, dissipating heating emitted in the region of the LED 10 inside the chamber 1. Since the representation is schematic, the means for supporting the LED 10 in the headlight and the printed circuit on which it is attached are not shown.

The wall of the casing 5, incorporates a heat exchanger 16 provided with vanes 17 extending outside the chamber 1 and inside a duct 20 (FIG. 3B). This duct 20 comprises an air inlet 22, positioned under the casing 5, and an air outlet 23. When the vehicle is moving, air will be swept inside the duct 20 through the inlet 22, and will leave in the region of the outlet 23 of the duct. The heat dissipated inside the chamber 1 is transferred from inside the chamber to outside the chamber by the heat exchanger 16 and circulation of air over the vanes 17 will evacuate heat emitted by the heat exchanger 16. Although the duct 20 can emerge directly into the engine compartment, the outlet 23 is preferably connected to an air duct leading the air directly from the duct to an air outlet (not shown) of the body of the vehicle.

Figure 2:
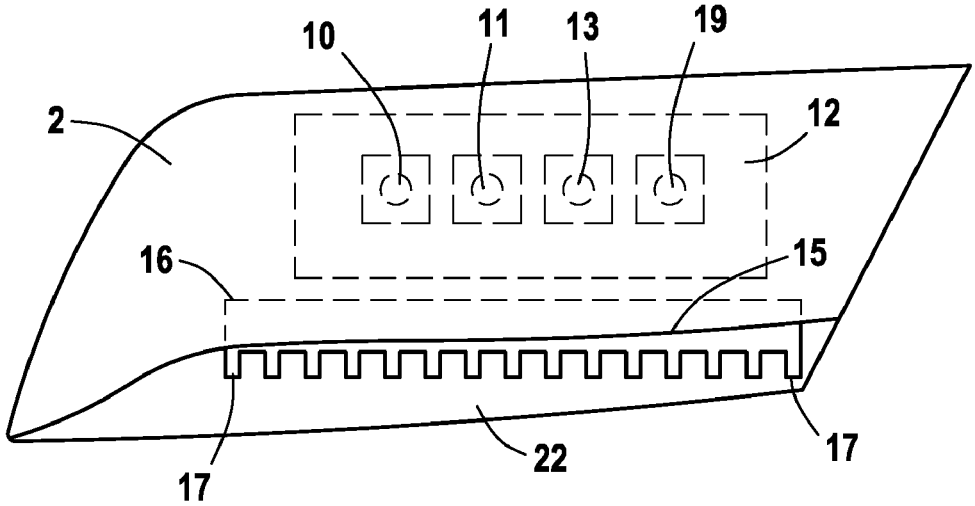
FIG. 2 is schematic representation of a front view of the lighting device of FIG. 1.

Since FIGS. 1 and 2 are schematic representations, they equally apply to two embodiments of the duct. According to one of these embodiments, the duct 20 is incorporated in the headlight. According to another embodiment, part of the inner wall of the duct 20 consists of a part 15, 16 and 14 (FIG. 3C) of the outer wall of the casing 5, and a part 26 of the inner wall of the duct consists of an element of the vehicle body, the space between the part 26 and the part 15, 16 and 14 constituting the interior of the duct 20. It is also possible, according to an embodiment (not shown) to produce a duct that is a part incorporated in the vehicle and that is in contact with a heat exchanger of the casing of the headlight.

As shown in FIG. 1, the part of the casing that is not in contact with air circulating inside the duct 20 is insulating, in order to prevent heat exchange between the chamber 1 and the interior of the body of the vehicle, where the temperature is high. In the example shown, this part is insulating since it consists of a double wall, that is to say of two walls 5*a* and 5*b* joined at their ends but of which the edges are separated by a space, so that the walls 5*a* and 5*b* form a hermetically sealed cavity 4. The cavity 4 may be filled with air or any suitable gas under reduced pressure or under an excess pressure, or at a pressure of which the order of magnitude corresponds to that of atmospheric pressure. It may also be filled with any thermally insulating material or liquid. One or other of these walls may also be covered with an insulating material deposited by flocking or of an insulating paint. According to an alternative embodiment (not shown), a single wall can also be used treated with such a coating. The implementation of a double wall is preferred.

As shown in FIG. 1, the part 15 of the casing 5, extending from the bottom of the glass to the heat exchanger 16, and the part 14 of the casing 5, extending from the heat exchanger 16 to the air outlet 23, are in contact with air circulating in the duct and are preferably single non-insulating walls.

As shown in FIG. 2, the headlight forms a lighting function by means of four power LEDS, 10, 11, 13 and 19. The choice of the number of LEDs is made simply according to the intensity of luminous flux generated by the LEDs used and the flux intensity necessary for obtaining the desired lighting function. The device according to the present invention is sufficiently effective in evacuating heat that these LEDs will generate.

FIGS. 3A to 3C show variants of this first embodiment where the inlet 22 and the outlet 23 of the air duct are positioned in different locations.

FIG. 3A differs slightly from the representation of FIG. 1, by the positioning of the outlet 23 at the bottom of the headlight.

In the variant shown in FIG. 3C, the inlet of the duct 20 is not positioned under the glass 2 but lower down inside the front bumper 8 of the vehicle. The part of the casing extending from the bottom of the glass to the heat exchanger is made with a double wall. According to the profile of the vehicle, this type of embodiment can enable air to enter more easily inside the duct. This also makes it possible not to take account of the air inlet in the design of the style of the glass.

In the variants shown in FIGS. 3A and 3C, as with the variant shown in FIG. 1, the parts being in contact with air circulating in the duct 20, 5 and 14 in FIG. 3A, and 14 in FIG.

3C, are not insulating. The parts of the wall of the casing 5 directly in contact with the inside of the vehicle consist, on the other hand, of a double wall.

FIG. 3B differs from the other variants in that the duct 20 completely encircles the casing 5. The duct is provided with two air inlets 21 and 22, at the top and bottom of the glass 2, and with an air outlet 23 emerging inside the engine compartment or connected to an air outlet (not shown) positioned on the body of the vehicle. On account of this, it is not necessary to insulate the casing 5 since all its walls 14 and 15 are in contact with air circulating in the duct.

Figure 4:
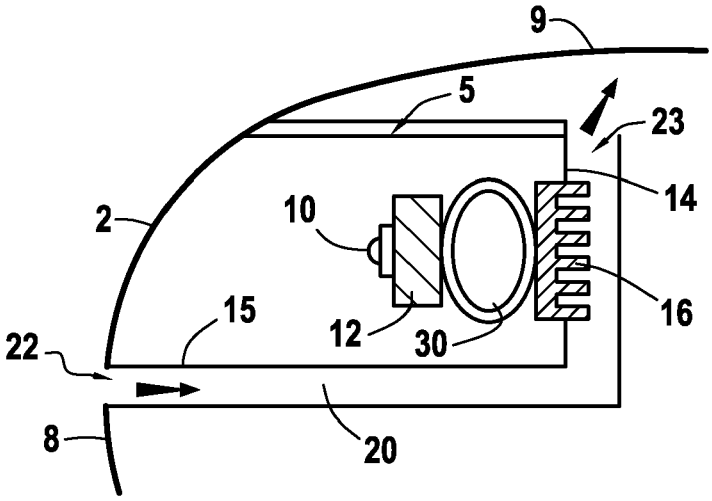
FIG. 4 is schematic representation of a section of a lighting device according to the present invention along the longitudinal axis of a vehicle, according to a variant of a first embodiment shown in FIG. 1.

According to a preferred embodiment shown in FIG. 4, a heat conductor 30 directly connects the heat dissipater 12 of the LED 10 to the heat exchanger 16. This heat conductor 30 may be made of any thermally conducting material. Use may also be made, in place of the heat conductor, of a heat pipe or a Peltier element. A "Peltier element" is understood to mean an element using the Peltier effect or thermoelectric effect. This Peltier element is composed of semiconducting materials having good thermoelectric properties and positioned in pairs between two walls so that, when an electric current passes through them, it creates a heat flow between the two walls. Within the context of the present invention, the Peltier element (not shown) is positioned between the heat dissipater and the heat exchanger so as to serve as a heat pump.

The headlight shown in FIGS. 1 to 4 possesses a glass area less than the area of the casing. On account of this, evacuation of heat through the glass will not be sufficient where the temperature outside the vehicle is high (for example 40° C.). The present invention makes it possible, by evacuating heat by air circulation in the region of a heat exchanger, as shown, to have effective evacuation of heat generated inside the chamber 1, 101, even with a small glass area. The effectiveness of this embodiment will make it possible to reduce the temperature inside the casing by at least 10 to 20° C. and in this way to use heat exchangers 16, 116, made simply of extruded metal or even extruded aluminum, that is less costly than copper.

According to preferred variants, (not shown) the wall of the air duct situated between the inside of the duct and the outside of the headlight is insulated, when the duct is incorporated in the headlight, or between the inside of the duct and the outside (usually the engine compartment) of the housing receiving the headlight, when the duct consists of the space between the outer wall of the casing and an element of the body of the vehicle (for example the walls of the housing in the body for housing the headlight). It is possible in this way for example to insulate only this wall of duct and not those of the chamber, and consequently the duct passes between the chamber and the engine compartment. This is of particular value when the duct surrounds the projector as is shown in FIG. 3B. For example, a variant of the headlight shown in FIG. 3B may be made where the walls of the duct situated facing the walls 14 and 15 of the chamber are insulated. It is also possible to insulate the walls of the chamber at the same time, to the exclusion of course of the heat exchanger 16, and the walls separating the inside of the duct from the rest of the vehicle (namely the interior of the vehicle and the outside of the headlight, when the duct is incorporated in the headlight, or the outside of the housing receiving the headlight, when the duct consists of the space between the outer wall of the casing and the housing provided in the body for placing the headlight).

Figure 5:
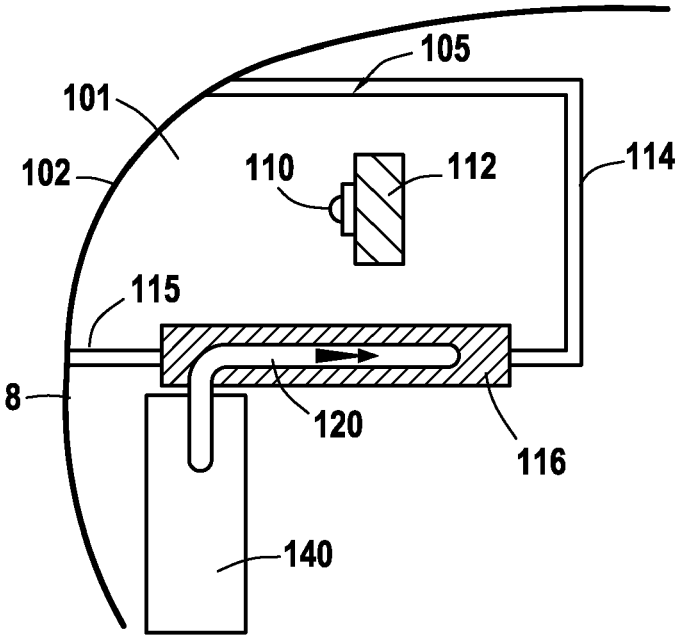
FIG. 5 is a schematic representation of a section of a lighting device according to the present invention along the longitudinal axis of a vehicle, according to a second embodiment.

According to a second embodiment shown in FIG. 5, the casing 105 of the head lamp incorporates a heat exchanger 116, directly in contact with a duct 120 that is connected to the cooling system 140 of the vehicle. The remainder of the wall of the casing is insulating and consists of a double wall. The double wall 114, 115 is made according to the same principle as previously described. The casing 105 is closed by a glass 102, in this way defining a chamber 101 inside which the LED 110 is positioned. The heat generated by the LED 110 is dissipated by a heat dissipater 112, on which the LED 110 is mounted. This heat diffuses inside the chamber 101 as is transferred outside this chamber 101 by the heat exchanger 116. The heat is then evacuated by the liquid of the cooling system 140 of the vehicle.

It should be noted that in FIGS. 1 to 5, the openings for the passage of electric wiring harnesses have not been represented. They are nevertheless present in such an embodiment.

The embodiments of the present invention are not limited to the examples referred to above. In particular, it would be possible to apply the present invention to signalling devices provided with LEDs or equally to lighting and/or signalling devices of which the light sources are in particular incandescent lamps, discharge lamps or halogen lamps.

Naturally, the present invention is given only by way of indication and other applications of the invention could be adopted without, for all this, departing from the scope thereof.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A lighting and/or signalling device for a motor vehicle comprising:

an outer wall delimiting the interior and exterior of a closed chamber, a casing;

a closing glass closing said casing, so that said casing and said closing glass form at least partly said outer wall of said closed chamber;

at least one light source inside said closed chamber; and at least one heat exchange zone for transferring heat from inside said closed chamber to outside said closed chamber, said outer wall including said at least one heat exchange zone;

said at least one heat exchange zone being able to be in contact with a fluid capable of circulating in a region of said at least one heat exchange zone, so that said fluid enables heat emitted in said region of said at least one heat exchange zone to be evacuated;

said casing further comprising an insulating wall continuous with said at least one heat exchange zone.

2. The lighting and/or signalling device according to claim 1, in which said at least one light source comprises at least one LED.

3. The lighting and/or signalling device according to claim 1, in which said at least one light source is mounted on a heat dissipater that is connected to said at least one heat exchange zone by a heat conducting device such as a heat conducting material, a heat tube or a Peltier element.

4. The lighting and/or signalling device according to claim 1, in which said insulating wall comprises at least one closed cavity.

5. The lighting and/or signalling device according to claim 4, in which said insulating wall comprises two walls separated from each other by a space.

6. The lighting and/or signalling device according to claim 1, in which said casing includes at least one heat exchange zone.

7. The lighting and/or signalling device according to claim 6, additionally comprising a duct for circulation of a fluid in contact with at least part of said heat exchange zone of said casing.

8. The lighting and/or signalling device according to claim 7, in which said duct comprises a first opening, said opening being positioned in a region of an end of said casing in contact with said closing glass.

9. The lighting and/or signalling device according to claim 7, in which said duct is designed to be connected to a cooling system of part of a vehicle, said cooling system cooling an engine of said vehicle, said cooling system for a passenger compartment of said vehicle or any other cooling system for part of said vehicle, so that a cooling fluid of said cooling system circulates inside said duct.

10. The lighting and/or signalling device according to claim 1, in which said at least one heat exchange zone comprises a heat conducting material.

11. The lighting and/or signalling device according to claim 10, in which said at least one heat exchange zone of said casing is a radiator made of extruded metal.

12. A vehicle having:

a lighting and/or signalling device according to claim 1, and a duct for circulating a fluid in contact with at least one heat exchange zone of said casing of said lighting and/or signalling device, so that said fluid makes it possible to evacuate heat emitted in a region of said at least one heat exchange zone of said casing.

13. The vehicle according to claim 12, in which said duct is connected to an air intake outside said vehicle, enabling air outside said vehicle to circulate inside said duct.

14. The vehicle according to claim 13, in which said air intake is connected to an already existing air inlet of said vehicle, or to an inlet situated sufficiently low at a front of said vehicle, in particular in a region of a bumper.

15. A lighting and/or signalling device heat dissipator for a motor vehicle comprising:

a wall adapted to define a chamber;

a casing;

a closing glass closing said casing, so that said casing and said closing glass form at least partly said wall of said chamber, said chamber being adapted to receive at least one light source; and at least one heat exchange zone for transferring heat from an inside of said chamber to an outside of said chamber, said wall including said at least one heat exchange zone;

said at least one heat exchange zone being adapted to be in contact with a fluid capable of circulating in a region of said at least one heat exchange zone, so that said fluid enables heat emitted in said region of said at least one heat exchange zone to be evacuated from said chambers;

said casing further comprising an insulating wall continuous with said at least one heat exchange zone.

16. The lighting and/or signalling device heat dissipator according to claim 15, in which said at least one light source comprises at least one LED.

17. The lighting and/or signalling device heat dissipator according to claim 15, in which said insulating wall comprises at least one closed cavity.

18. The lighting and/or signalling device heat dissipator according to claim 15, in which said casing includes at least one heat exchange zone.

* * * * *